United States Patent [19]

Hobson

[11] 4,259,994

[45] Apr. 7, 1981

[54] PRODUCTION OF TERRY FABRICS FOR TOWELS

[76] Inventor: Victor Hobson, Park Mill, Halstead La., Barrowford, Nelson, County of Lancaster, England

[21] Appl. No.: 57,799

[22] Filed: Jul. 16, 1979

[30] Foreign Application Priority Data

Sep. 16, 1978 [GB] United Kingdom ..... 37113/78

[51] Int. Cl.[3] ..... D03D 39/00

[52] U.S. Cl. ..... 139/1 R; 139/25; 28/184; 112/79 A

[58] Field of Search ..... 139/1 R, 25, 35, 291 R; 28/184, 214; 112/79 A

[56] References Cited

U.S. PATENT DOCUMENTS

| | | | |
|---|---|---|---|
| 2,002,359 | 5/1935 | Baylis | 28/184 |
| 2,522,816 | 9/1950 | Fiderer | 28/184 |
| 3,623,440 | 11/1971 | Spedding et al. | 112/79 A |
| 4,015,550 | 4/1977 | Bartenfeld et al. | 112/79 A |
| 4,106,416 | 8/1978 | Blackstone et al. | 112/79 A |

*Primary Examiner*—Henry Jaudon

[57] ABSTRACT

A method for the production of a patterned fabric comprising producing a design pattern, elongating the design pattern in length in proportion to the length of the pile warp yarn to the length of the ground warp yarn, engraving the elongated design onto printing rollers or rotary screens and printing the design onto the pile warp yarn, and winding the printed warp onto a warp beam, transferring the printed pile warp beam to a terry loom and weaving a terry fabric with the length of the pile warp yarn in a predetermined ratio to the length of the ground warp yarn to form the pile.

6 Claims, 4 Drawing Figures

PRODUCTION OF TERRY FABRICS FOR TOWELS

This invention relates to an improved method for the production of terry fabrics for towels having two sets of warp yarns of the kind in which warps which produce the pile are printed in the form of a sheet of warps of the required pattern and to compensate for the shortening of the warp length when the pile loops are formed, the pattern when printed is enlarged in the direction of the warp length.

In the weaving of terry towelling three series of yarns are employed (a) pile warp which produces the loops for the pile surface (b) ground warp from which the pile warp projects and (c) weft which binds the two warps together.

Apart from its absorbent qualities the pile warp is also used to ornament the fabric. Jacquard mechanism has been used in the production of floral and other intricate ornamentation on terry towels. Coloured threads are introduced into the pile warp for this purpose and the general description given to this method of ornamentation is extra warp figuring. As the pile warp produces loops it is obvious that for a given length of fabric, mere pile warp yarn must be used than ground warp yarn. In actual fact, depending upon the quality and type of material, the difference can be between 3:1 to even 6:1 and more. Until recently, it was difficult to determine, with any degree of accuracy, a constant rate of delivery of pile warp yarn per unit length, hence the description of terry weaving as negative warp pile fabric. But, developments in technology have now made it possible to deliver a positive amount of pile warp yarn per unit length. Consequently, if the pile warp is set to deliver at a ratio of 4:1 to the ground warp and if a simple oblong which measures one inch wide and four inches long is printed onto the pile warp, the result will be a square one inch wide and one inch long in the woven terry.

The ground warp yarns are drawn from one warp beam and the pile loop yarns are drawn from a second warp beam. In this example, four times the length of warp is drawn from the pile warp beam than from the ground warp beam and the reed beats up the loop into the fell of the cloth on fast picks.

According to the invention a method is provided for the production of a patterned terry fabric comprising producing a pattern, elongating the design pattern in length in proportion to the length of the pile warp yarn to the length of the ground warp yarn, engraving the elongated design onto printing rollers or rotary screens and printing the design onto the pile warp yarn and winding the printed yarn onto a warp beam transferring the pile warp blank to a terry loom, and weaving a terry fabric with the length of the pile warp yarn in a predetermined ratio to ground warp yarn to form the pile.

A drawing of the desired design is made and for a 4:1 pile to ground warp yarn in length the drawing is produced in which the length of the original drawing is increased four fold. Thus if the original drawing is four inches square it is increased to sixteen inches in length whilst remaining four inches in width.

The elongated design is then printed, using any suitable machine, and if the terry fabric is woven 48" wide, containing 25 pile warp ends per inch of 2/20 cotton yarn there are 1200 pile warp ends equally spaced over the 48". An expanding comb through which the ends are laid before running through the printing machine maintains the position of the threads and after printing and drying the yarn is run onto a beam 48" between flanges. A striking comb is introduced at the doffing to maintain the position of the threads and the beam is ready for the loom.

The towels are woven in the finished state and because of the nature of the pile warp used, generally two fold cotton with a low number of folding turns per inch, the effect is to produce upstanding loops which enhance the appearance by standing up clearly and not lying flat, which is the case when using single twist pile yarn containing many turns per inch.

In known towels produced using a jacquard mechanism the floral portion of the towel may be relatively small and may take up less than one third of the towel, the remainder being a plain terry structure. Consequently two thirds of the jacquard figuring capacity is wasted. By eliminating the jacquard mechanism altogether and using tappet or dobby mechanism the weaving efficiency is greatly increased, giving a higher production rate, less faulty cloth, more looms per weaver and overlooker, the cost of the jacquard mechanism and harness, and eliminating replacement costs. Printed elongated pile warps repeat exactly on both sides of the towel, which is not possible with jacquard figuring.

One of the benefits of the conventional printing of flat fabrics is that large stocks of grey cloth can be stored and then printed according to the dictates of fashion and commercial demand. It is important to consider the utilitarian advantages as well as the benefits of printing elongated patterns onto pile warp yarn which can be enumerated as follows:

1. Pile fabrics can be cropped on one side and are then called Terry Velour. Jacquard figuring is used to ornament this type of fabric which is used for expensive furnishings, leisurewear, beachwear and robes, dressing gowns etc. In first grade velour no uncut loop must be visible after cropping.

Pile height variations necessitate the cutting off of more pile material resulting in a higher waste factor. It is common to lose one third of the weight of the material which makes this type of fabric very expensive to produce. Pile height variations are influenced by changing the pile direction from the face to the back of the fabric to produce the design. A plain terry structure with a printed warp pattern is more even in pile height and less waste results in cropping.

The design may be on the face side only, the reverse being ecru or bleached, or the design may be on the face side only with no loops on the reverse side, thus producing a lighter fabric or using a closer set warp with a denser pattern on the face of the cloth. In this case the loops would be more firmly bound into the fabric. Using a double ground warp and pile on the face only would also bind in the loops more firmly.

2. Doubling the number of ends per inch before printing and afterwards splitting onto two weavers beams and a double headstock.

3. Splitting a second time and producing four weavers beams in conjunction with beams containing the same number of ends which have been conventionally prepared. This will give a printed floral design on the face of the towel and be either plain, coloured, striped, or bleached on the back.

4. The optimum utilisation will be in the production of towels containing a minimum of floral decoration. In this case printed battery warps will be combined with standard warps.

The battery beam providing the floral decoration and the standard beams provide a full range of colour variation. For example two towels 24" wide may be produced side by side in a loom. Each towel has one third of the pile warp printed with a floral design in the form of two four inch bands and the remainder of the pile warp is from standard beams. The warp pattern for each towel is 2" plain terry 4" floral border 12" plain terry 4" floral border 2" plain terry. A warpers beam containing 1200 ends of 2/20 bleached cotton 9–10 turns per inch×3000 yards is first produced. From a floral design 4"×4" the design is elongated to 16"×4" and 12 repeats of the design are engraved widthways across the printing machine i.e. 12 patterns×4"=48". The yarn is run through the printing and drying process, ensuring that the position of the yarn is maintained by an expanding comb at the front of the machine, onto a battery beam containing flanges which split the yarn into three equal sections, each section containing four repeats of the pattern i.e. 400 ends per section. Two standard beams B and C are produced each containing 400 ends×3000 yards, the warp pattern being for example 200 blue, 200 gold for each beam. A battery warp A is placed in the backmost position to run through a dry taping machine. The standard warp beams B and C are placed in front of beam A. Using the first section only, of the battery warp A and all of the standard warp beams B and C, to lay in the pattern, after running over guide bars, and through the dents in the expanding comb at the headstock. The complete pattern will make one weavers beam 1200 ends×3000 yards or two weavers beams 1200 ends×1500 yards. Each beam will produce blue towels with floral borders at one side and gold towels with floral borders at the other side.

The process can be repeated using the second section of the battery beam in conjunction with pink and green standard beams. This is then repeated again using the third section of the battery beam and lilac and orange standard beams. If the battery beam were split end to end onto two battery beams and the number of ends on the standard beams would be increased proportionately, 12 weavers beams×1500 yeards could be produced by having the floral border woven on the face side only.

To produce a range of different widths of towel it is only necessary to vary the size of the original design before printing the warps.

Dobby patterning may be used to further enhance the appearance of the towel by using plain terry, geometric figuring, sculptured effects etc.

The drafting of the warp in the reed takes into account the cloth contraction and shrinkage after laundering.

Good warp preparation is essential as missing or broken ends from the pile warp beam may effect the pattern.

The ground and pile warp yarns are woven in the loom in known manner.

The width of towel, yarn counts, and number of ends per inch are given by way of illustration and maybe varied to meet particular requirements.

The invention will be further described with reference to the accompanying drawings.

Figure 1:
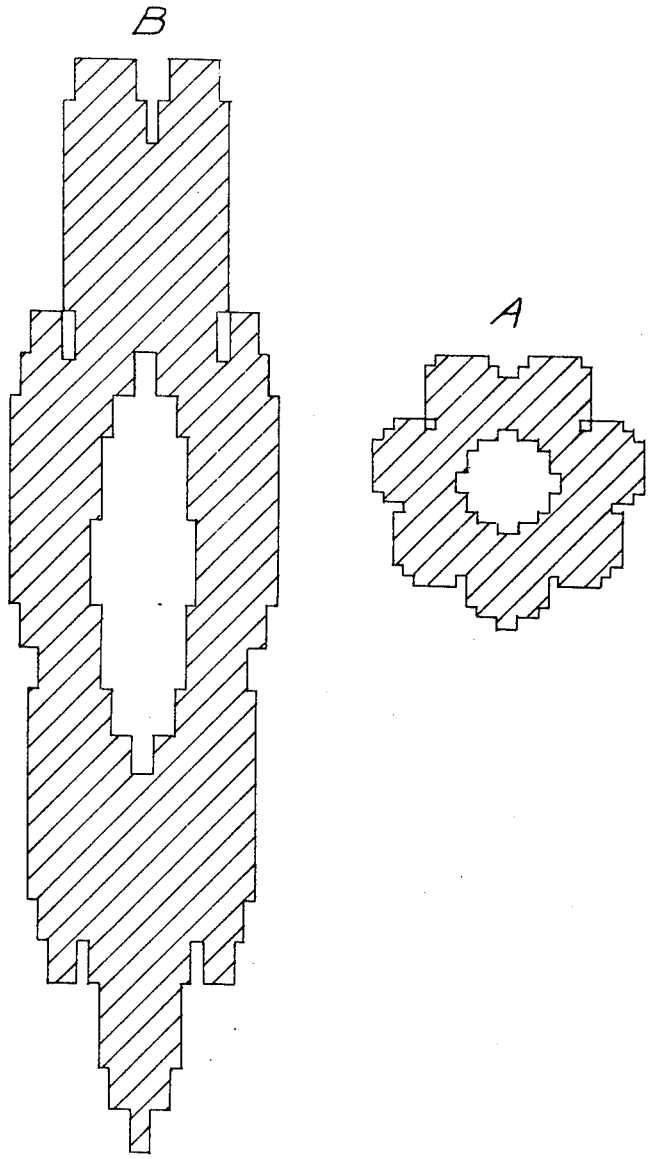
FIG. 1A is a simple floral design, actual size after weaving.
FIG. 1B is the design elongated with a 4-1 ratio length to width to be printed on the pilewarp yarns before weaving.
Figure 2:
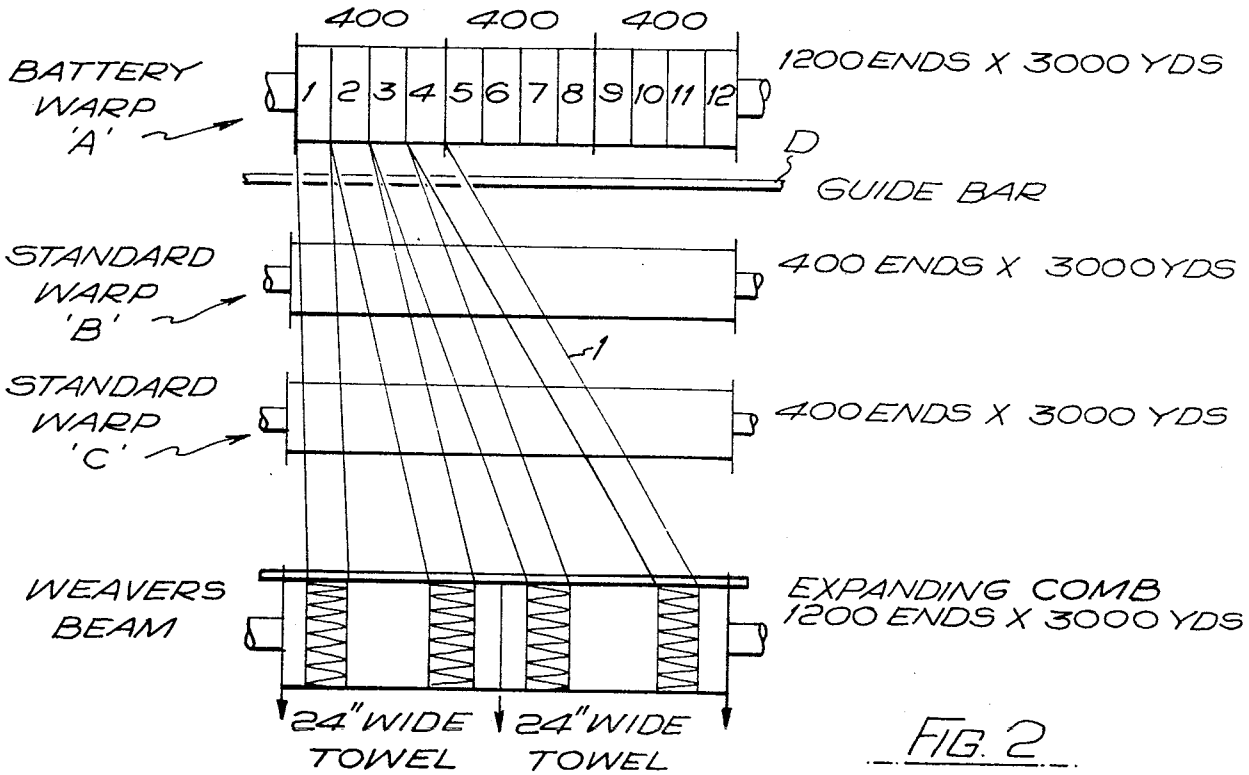
FIG. 2 illustrates the use of a printed battery pile warp yarn to produce a plurality of weavers beams when used in conjunction with conventionally produced standard warp pile beams. The guide bar D raised above the beam flanges permits the yarn to spread evenly and not become entangled.
Figure 3:
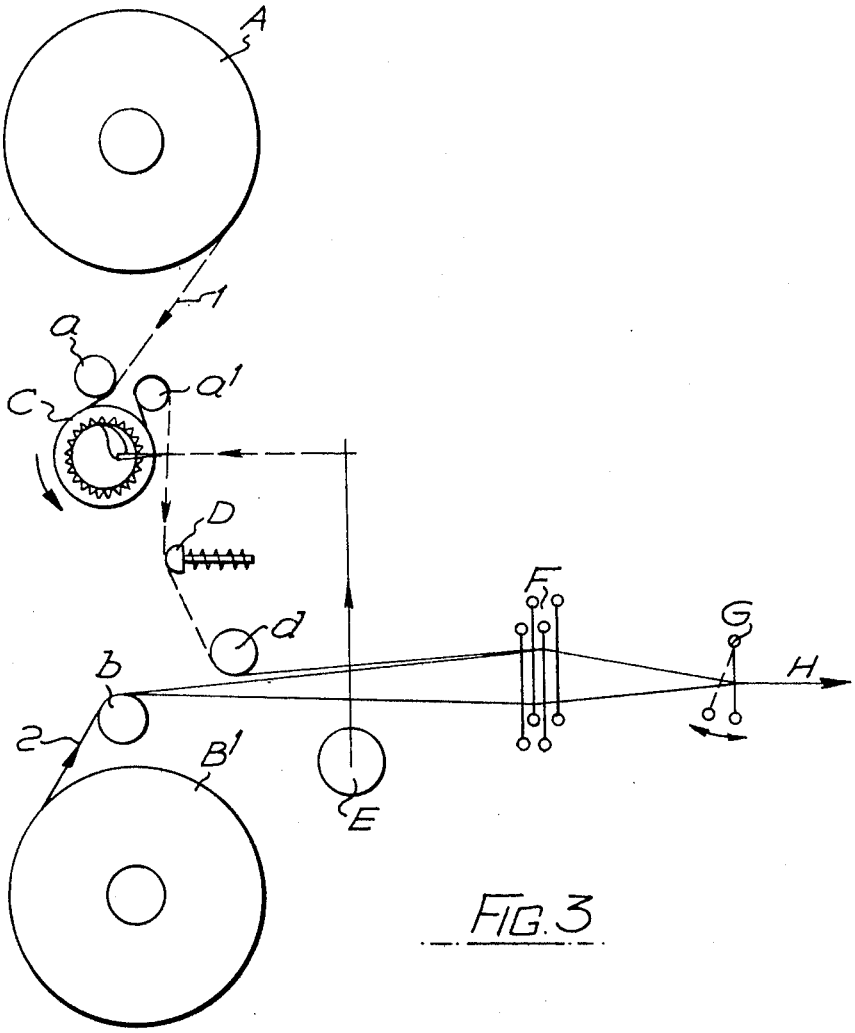
FIG. 3 is a diagrammatic side view of a loom for controlling the ratio of delivery of pile warp to ground warp.

The loom comprises a pile warp beam A, a ground warp beam B, healds F, a reed G, a pile warp delivery roller C and a spring loaded pile warp tensioning bar D.

In weaving the pile warp yarn 1 is drawn from the beam A by the delivery roller C which is coated with an abrasive sleeve of emery or other friction material. The roller C is driven through gearing, not shown, from a drive E from the loop top shaft (crank shaft). The warp passes under a guide bar a, around the roller C and over a second guide bar $a^1$ and around a position bar d, the spring loaded tension compensating bar D maintaining a uniform tension on the yarn.

Ground warp 2 is drawn from the beam $B^1$ and passes over a guide bar b and both yarns 1 and 2 pass to the heald frames F and through the read G. From the front of the loom the pile warp yarn is drawn through the first two healds and the ground warp yarn is drawn through the back two healds.

The rate of pile warp delivery is controlled by pawls actuated by levers (not shown) operated from the crank shaft to rotate the delivery roller C.

The reed is set to fall back sufficiently on loose pick formation to allow the correct length of warp loop to be beaten up into the foll of the cloth H on fast picks.

What I claim is:

1. A method for the production of a patterned terry fabric comprising producing a design pattern, elongating the design pattern in length in proportion to a predetermined ratio of the length of the pile warp yarn relative to the length of the ground warp yarn, engraving the elongated design onto printing rollers or rotary screens and printing the elongated design onto the pile warp yarn, winding the printed pile warp yarn onto a warp beam, transferring the printed pile warp beam to a terry loom, and in association with ground yarn weaving a terry fabric with the length of the pile warp yarn being supplied in the predetermined ratio to the length of the ground warp yarn to form the pile.

2. A method for the production of a patterned terry fabric as in claim 1, comprising printing a plurality of repeats of the design transversely in order to weave two or more towels side by side from the same weavers beam.

3. A method for the production of a terry fabric patterned as in claim 1, comprising doubling the number of warp ends per inch and subsequently dividing the printed warp ends and winding them onto a plurality of weavers beams.

4. A method for the production of a patterned terry fabric as in claim 1 for a 48" wide towel containing 25 pile warp threads per inch of 2/20 cotton for a total of 1200 warp ends equally spaced over 48" and winding the printed warp ends equally spaced onto a beam 48" between flanges.

5. A method for the production of a printed battery beam in accordance with the provision of claim 1 combined with standard beams to produce a plurality of pile warp weavers beams using differently coloured pattern arrangements in the portion of the towels composed of the standard beam ends.

6. A method for the production of a patterned terry fabric comprising producing a pattern of the design elongating the design pattern only in length in proportion to a predetermined ratio of the length of the pile warp yarn relative to the length of the ground warp yarn, engraving the elongated design onto printing rollers or rotary screens and printing the elongated design onto the pile warp yarn, drying the printed yarn and winding the printed yarn through an expanding comb onto a warp beam, transferring the pile warp beam to a terry loom employing tappet or dobby mechanism, maintaining the yarn equally spaced over the width of the fabric, and weaving a terry fabric with the length of the printed pile warp yarn being supplied in the predetermined ratio to the ground warp yarn to form the pile with an identical pattern of each side of the fabric.

* * * * *